US009556611B1

(12) United States Patent
Huckey et al.

(10) Patent No.: US 9,556,611 B1
(45) Date of Patent: Jan. 31, 2017

(54) METHODS AND APPARATUSES FOR TEMPORARY FLOOR ASSEMBLY

(71) Applicant: THE BOEING COMPANY, Chicago, IL (US)

(72) Inventors: Andrew M. Huckey, Charleston, SC (US); Jake A. Wilson, Charleston, SC (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 14/926,765

(22) Filed: Oct. 29, 2015

(51) Int. Cl.
*E04B 5/02* (2006.01)
*E04G 5/08* (2006.01)

(52) U.S. Cl.
CPC .. *E04B 5/02* (2013.01); *E04G 5/08* (2013.01)

(58) Field of Classification Search
CPC ..... E04B 5/02; E04G 5/08; E01C 2013/006; E01D 15/122; E04C 3/005
USPC ..... 52/506.01, 745.13; 404/35, 41
See application file for complete search history.

(56) References Cited

U.S. PATENT DOCUMENTS 3,918,222 A * 11/1975 Bahramian ..... E04B 5/04 29/452
4,568,587 A 2/1986 Balzer
4,654,245 A 3/1987 Balzer et al.
4,681,482 A * 7/1987 Arciszewski ..... E01C 19/522 14/2.4
5,947,178 A * 9/1999 Patten ..... E04H 4/088 160/193
6,171,015 B1 * 1/2001 Barth ..... E01C 5/001 404/34
6,874,972 B2 * 4/2005 Davis ..... E01C 9/086 238/14
7,090,430 B1 8/2006 Fletcher et al.
7,108,902 B2 9/2006 Ellingson
7,114,298 B2 10/2006 Kotler
7,137,226 B2 * 11/2006 Fiutak ..... B27M 3/0053 52/177
7,364,383 B2 4/2008 Fletcher et al.
7,690,160 B2 4/2010 Moller, Jr.
7,918,623 B2 * 4/2011 Lacroix ..... E01C 5/005 404/35
8,161,690 B1 * 4/2012 Borne ..... E04B 5/12 404/35
8,161,890 B2 4/2012 Wang
8,216,659 B2 * 7/2012 Zafiroglu ..... B29C 43/222 428/131
8,784,002 B2 * 7/2014 Ringus ..... E01C 9/02 14/2.5
2007/0062147 A1 3/2007 Wright

* cited by examiner

*Primary Examiner* — Charles A Fox
*Assistant Examiner* — Joseph J Sadlon

(57) ABSTRACT

Methods and apparatuses are disclosed for removably deploying a floor assembly from a compacted state to a deployed state by varying tensioning forces to removably interconnected individual floor segments.

14 Claims, 7 Drawing Sheets

METHODS AND APPARATUSES FOR TEMPORARY FLOOR ASSEMBLY

TECHNOLOGICAL FIELD

The present disclosure relates generally to the field of temporary flooring and, more specifically, to improved methods, apparatuses and systems for deploying, using, removing and storing a temporary and removable floor assembly.

BACKGROUND

In the construction of large structures, temporary supports are often placed to allow workers and materials to be brought in close proximity with work being done on the structure. In many construction scenarios, the work to be done is located in elevated areas. As a result temporary support structures or scaffolds are often built to assist workers and otherwise create temporary platforms on which to stand or hold building materials, tools, etc. Many large structures being built or requiring repair, etc. also require the placement of temporary exposed beams that span or be suspended over otherwise "open" areas. During construction or repair of the structure workers may traverse the exposed beams to assemble structure parts, install fixtures, etc. To prevent falls and injury, workers may be harnessed to a secure part of the structure, or to the scaffolding. Alternatively the scaffolding could be built up around the large structure so the worker would not need to walk across the exposed beams over the open areas. However, scaffolding may be cost or size prohibitive.

To prevent workers from walking on exposed beams in a dangerous fashion, temporary floor panels may be positioned across the exposed beams. However, such floor panels may be unwieldy and/or difficult to deploy and position, and then remove when the construction is complete. For example, each floor panel may weigh in excess of 45 pounds (e.g. a plywood sheet), which must then be raised to the beams and positioned on the beams and then removed and lowered from the beams.

Automated machinery has been proposed to position the flooring and reduce the risk of injury to workers. However, the acquisition and use of such machinery is costly, and the machinery otherwise takes up significant space. Further, it may not be possible to orient such machinery depending on the structure being fabricated. Improved methods and apparatuses for deploying and removing temporary flooring would be advantageous.

BRIEF SUMMARY

According to one aspect, the present disclosure is directed to a method for installing a removable floor assembly comprising positioning a deployable floor assembly at a first location, said floor assembly positioned in a compacted state. The floor assembly comprises a plurality of floor segments, with the floor segments positioned substantially adjacent to one another, and a tensioning cable in communication with the floor segments, with a tensioning device in communication with the tensioning cable to apply a force to the tensioning cable. The compacted floor assembly is deployed from the compacted state at the first location to a deployed state. The tensioning device is actuated to apply a tensioning force to the tensioning cable.

According to another aspect, floor segments are dimensioned to removably interconnect with adjacent floor segments.

In another aspect, floor segments are dimensioned to temporarily mate with adjacent floor segments.

In yet another aspect, the compacted state comprises rolled floor segments, folded floor segments or combinations thereof.

In a still further aspect, the floor segments comprise integral channels to receive the tensioning cable.

In another aspect, at least a portion of the tensioning force is transferred from the tensioning cable to the floor segments.

In yet another aspect, the actuating device applies a tensioning force to the tensioning cable, with the force ranging from about 10 to about 100 lbs.

In another aspect, the tensioning cable is made from a material comprising nylon, steel, stainless steel, aluminum or combinations thereof, etc.

In still another aspect, the floor assembly is deployed onto a support.

In yet another aspect, the floor assembly comprises stops to orient the floor assembly relative to the support.

In a still further aspect, the method further comprises actuating the tensioning device to release tension on the tensioning cable, and retracting the floor assembly substantially to the compacted state.

According to a further aspect, the present disclosure is directed to a removable floor assembly comprising a plurality of adjacent floor segments, a tensioning cable in communication with the floor segments, and an actuating device in communication with the tensioning cable.

In another aspect, the tensioning device is actuated to apply a tensioning force to the tensioning cable.

In a further aspect, the floor assembly comprises a release mechanism in communication with the tensioning device.

In another aspect, the present disclosure is directed to a method of manufacturing a structure comprising, positioning a floor assembly at a first location, said floor assembly positioned in a compacted state. The floor assembly comprises a plurality of floor segments, said floor segments positioned substantially adjacent to one another, a tensioning cable in communication with the floor segments, with a tensioning device in communication with the tensioning cable to apply a force to the tensioning cable. The compacted floor assembly is deployed from the compacted state at the first location to a deployed state, and actuating the tensioning device to apply a tensioning force to the tensioning cable.

In yet another aspect, the structure is a stationary structure.

In a still further aspect, the structure is a vehicle.

In a further aspect, the vehicle may be a manned and unmanned vehicles including, without limitation, aircraft, spacecraft, rotorcraft, rockets, satellites, drones, terrestrial vehicles and surface and sub-surface waterborne vehicles, or combinations thereof

BRIEF DESCRIPTION OF THE DRAWINGS

Figure 1:
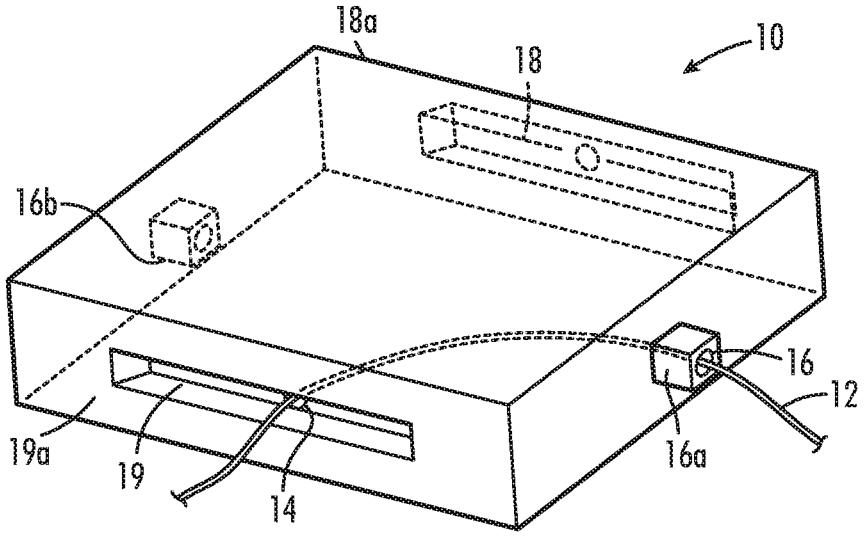
Figure 2A:
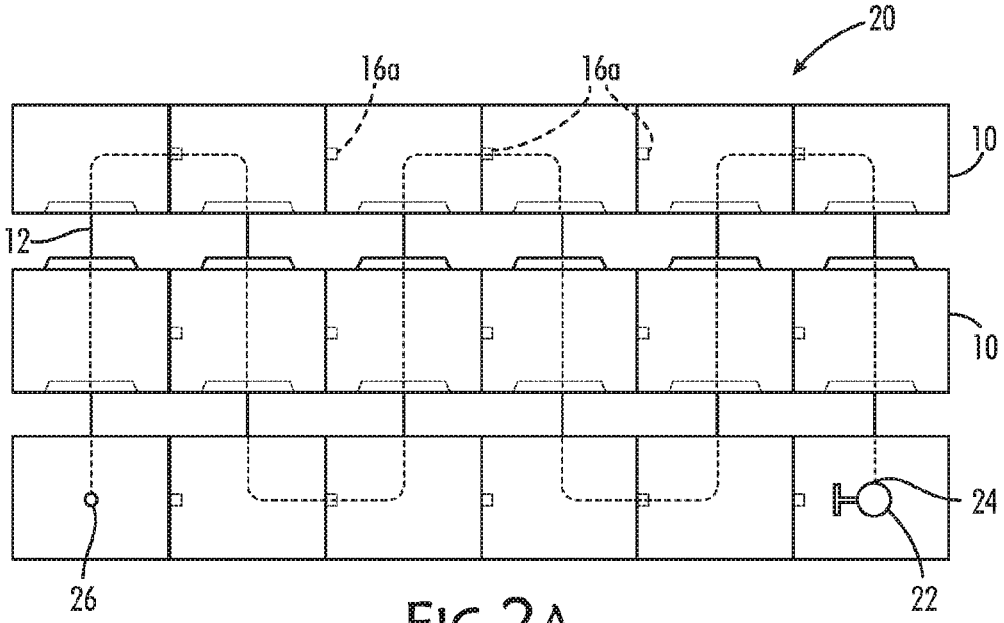
Figure 2B:
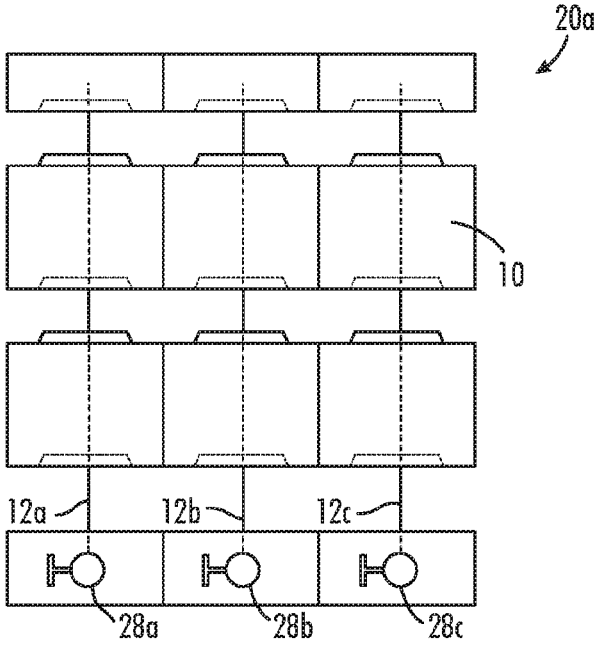
Figure 3:
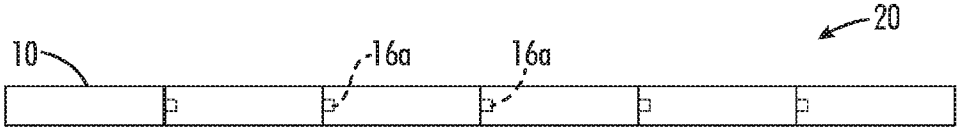
Figure 4:
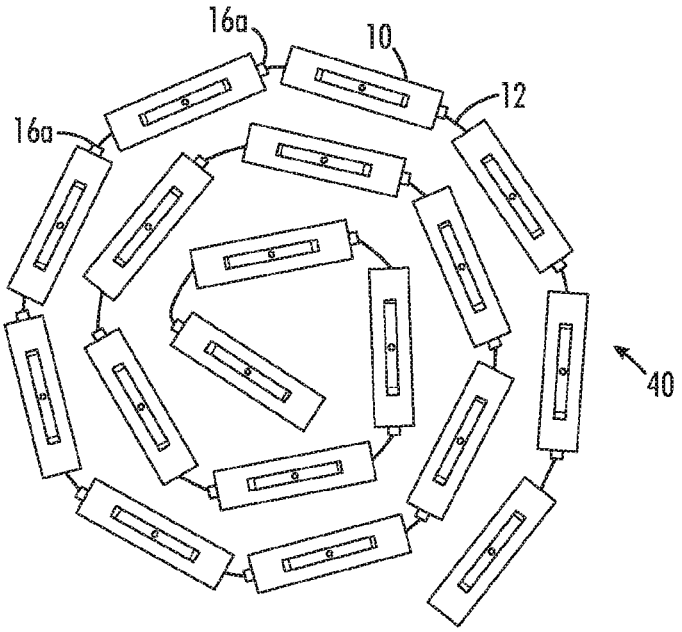
Figure 5:
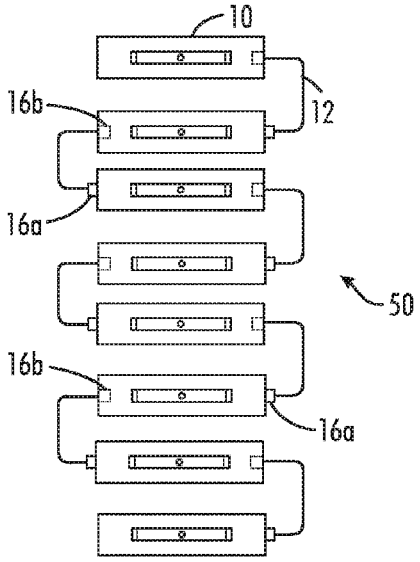
Figure 6:
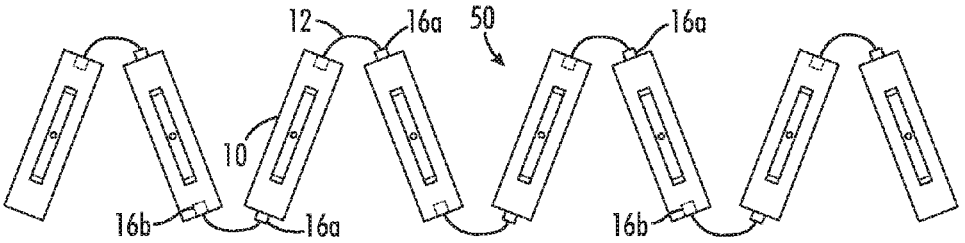
Figure 7:
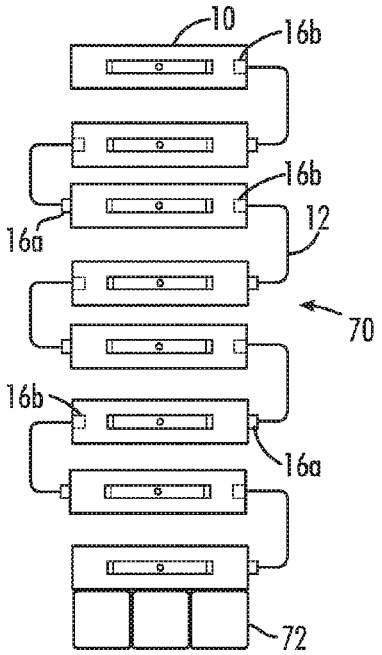
Figure 8:
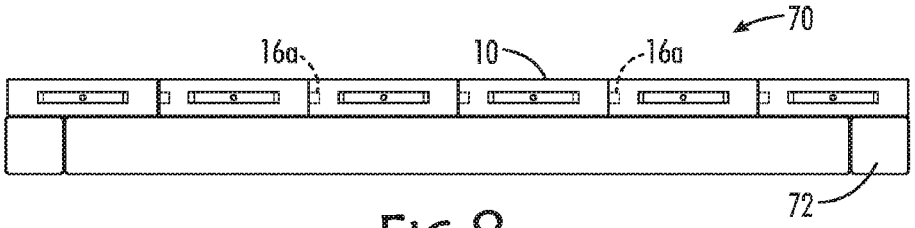
Figure 9:
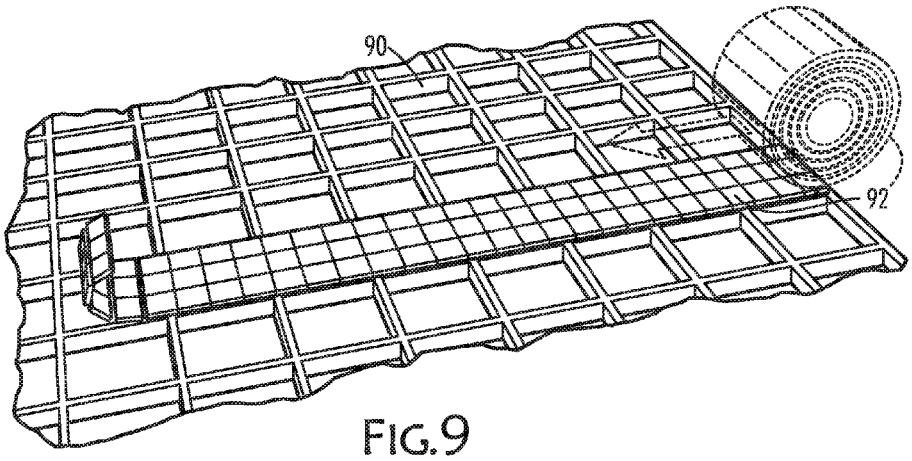
Figure 10:
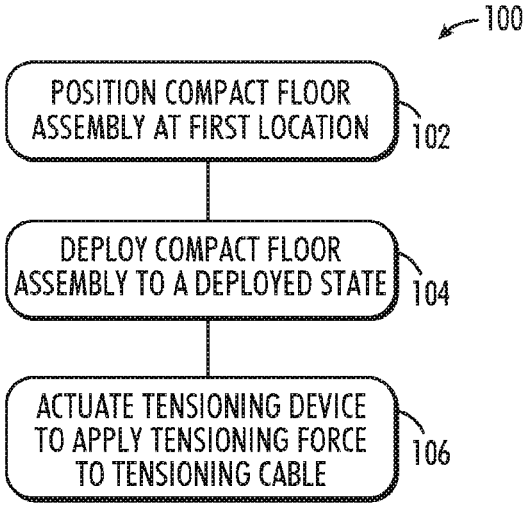
Figure 11:
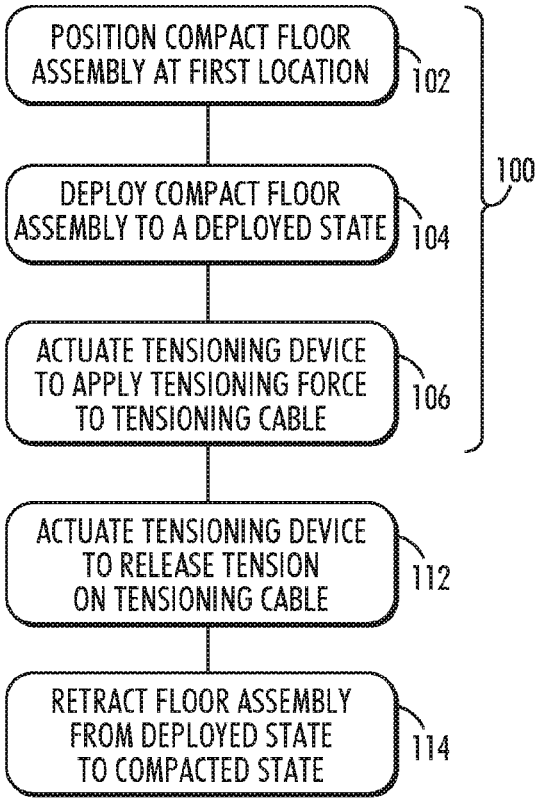

Having thus described variations of the disclosure in general terms, reference will now be made to the accompanying drawings, which are not necessarily drawn to scale, and wherein:

FIG. 1 is a perspective cutaway view of an aspect of the present disclosure;

FIGS. 2A and 2B are overhead plan views showing internal features of aspects of the present disclosure;

FIG. 3 is a perspective side view of an aspect of the present disclosure;

FIG. 4 is a side view of an aspect of the present disclosure in a compacted state;

FIGS. 5 and 6 are perspective side views of aspects of the present disclosure showing alternative compacted states;

FIG. 7 is a perspective side view side view of the aspect shown in FIG. 5, shown resting on a support;

FIG. 8 is a side view of an aspect of the present disclosure, showing a floor assembly deployed on a support;

FIG. 9 is a perspective view of an aspect of the present disclosure showing a partially deployed floor assembly on a support structure; and FIGS. 10 and 11 are flow charts outlining aspects of the present disclosure.

DETAILED DESCRIPTION

According to aspects, the present disclosure is directed to methods, apparatuses and systems for installing a removable floor assembly.

As shown in the FIGs. and otherwise described herein, a temporary, removable floor assembly comprises a plurality of floor segments, with the floor segments positioned substantially adjacent to one another. A tensioning cable is in communication with the floor segments, and a tensioning device is in communication with the tensioning cable to apply a tensioning force to the tensioning cable. The floor assembly is deployed from a compacted state to a deployed state, and the tensioning device is actuated via an actuating device to apply a tensioning force to the tensioning cable and, maintain the deployed floor assembly in the deployed state. When, and if desired, the tensioning device is actuated to release tension on the tensioning cable via a release mechanism, and the removable floor assembly is returned from its deployed state to its compacted state.

FIG. 1 shows, for illustration purposes only, a perspective view in cutaway fashion of one floor segment 10. Floor segment 10 comprises tensioning cable 12 which is threaded through floor segment 10 via first opening 14 and second opening 16. Floor segment 10 is shown with male mating feature 18 located on side 18*a* of floor segment 10, and a female mating recess 19 located on a side 19*a* of the floor segment 10. As shown, first opening 14 is located proximate to female mating recess 19. However, such arrangement is for illustrative purposes only. It will be understood that the first opening 14 on side 18*a* can be located anywhere on side 18*a* as desired. Reinforcement 16*a* reinforces the floor segment near the location of the second opening 16. Reinforcement 16*a* is dimensioned to engage with recess 16*b* in an adjacent floor segment, with recess 16*b* dimensioned to accommodate reinforcement 16*a*, and said reinforcement 16*a* dimensioned to removably interconnect individual floor segments with one another.

FIG. 2A shows on aspect of the present disclosure with a plurality of floor segments 10, together forming a portion of a floor assembly 20, with the floor segments 10 each in communication with tensioning cable 12. As shown in FIG. 2A, the tensioning cable 12 passes through each floor segment 10 such that the tensioning cable 12 enters and exits each floor segment 10 as needed to effect a semi-rigid temporary, removable floor assembly 20 when the tensioning cable 12 has a tensioning force applied thereto. Tensioning device 22 is shown in communication with tensioning cable 12 at a first end 24 of tensioning cable 12. A second end 26 of tensioning cable 12 is understood to terminate, and be held substantially in place, at a terminus 26. According to one aspect, as a tensioning force is applied to tensioning cable 12, the tensioning cable is "wound" more tightly. Such tensioning of the tensioning cable 12 brings the plurality of floor segments 10 more closely together until such floor segments removably or temporarily interlock, or mate, with one another, thus forming the temporary, removable floor assembly 20.

According to another aspect, FIG. 2B shows the floor assembly of FIG. 2A with an alteration 20*a* whereby a plurality of tensioning cables 12 are in communication with floor segments in a linear orientation, rather than the circuitous orientation shown in FIG. 2A. As shown in FIG. 2B, each tensioning cable 12*a*, 12*b*, 12*c* is directed to a corresponding tensioning device 28*a*, 28*b*, 28*c*. It is understood that during tensioning or release, the actuating devices 28*a*, 28*b* and 28*c* may be synchronized such that the tension delivered to the tensioning cables 12 would be substantially equivalent. In an alternate aspect, (not shown), it is understood that the tensioning cables 12 could be directed to a single tensioning device responsible for delivering a tensioning force to all tensioning cables substantially simultaneously.

FIG. 3 is a side view of the floor assembly of FIG. 2A shown with a tensioning force applied to the floor segments 10 of the floor assembly 20. Floor assembly 20 is therefore shown in its substantially linear, deployed state. The amount of tensioning force applied to the tensioning cable 12 via the tensioning actuating device 22 (Shown in FIG. 2A) is an amount of force required to maintain the temporary, removable deployed flooring assembly 20 is an adequately rigid or semi-rigid orientation, as desired.

FIG. 4 shows a compacted orientation 40 of a floor assembly 20 as shown, for example, in FIG. 3. As shown, and according to an aspect of the present disclosure, it is understood that the compacted orientation 40 allows the floor segments 10 of floor assembly 20 to be "rolled" into a compacted state. In this way, the compacted floor assembly may be positioned at a first location at which the floor assembly is to be deployed. According to one aspect, the compacted floor assembly 40 may be oriented such that it contacts or rests upon a structural support (not shown), such as, for example, parallel beams spaced a desired distance apart from one another. According to an aspect of the present disclosure, the structural support runs in a first direction, with the floor segments 10 oriented into rows that run perpendicular to the support structure. The compacted floor assembly 40 is deployed from the compacted state 40 to a substantially linear deployed state by, for example, unrolling the compacted floor assembly 40. This can be accomplished manually, whereby the compacted floor assembly 40 is "unrolled" from the compacted state to a deployed state. The actuating device can then be activated to deliver a tensioning force to the tensioning cable 12. A portion of the tensioning force is transferred from tensioning cable 12 to floor segments 10, first bringing floor segments more closely adjacent one another, until adjacently positioned floor segments removably mate or interlock with one another. In this way, a semi-rigid temporary, removable floor system is deployed, and also retained in a desired position on a structural support.

According to another aspect of the present disclosure, as the tensioning force is applied to the compacted floor assembly 40, the assembly 40 will unwind or unroll to a desired position in contact with a support structure. In other words, according to this aspect, the application of tensioning force to the compacted floor assembly serves to both unwind the compacted floor assembly to a desired position along the support structure, and then also tighten the floor assembly into the final, substantially linear and semi-rigid or rigid deployed state.

FIGS. 5 and 6 show another aspect of the present disclosure. According to this aspect, the compacted floor assembly may originate in a stacked orientation 50. When the compacted, stacked floor assembly is deployed, the compacted stacked floor assembly 50 may, for example, spread outwardly from the compacted state in an "accordion" fashion as the compacted stacked floor assembly 50 is deployed to a desired position along a support structure and then, as the tensioning force on the tensioning cable 12 increases, the floor segments in the floor assembly are made to removably mate or otherwise removably interconnect to achieve a final substantially linear and semi-rigid or rigid deployed floor assembly in the fully deployed state.

FIG. 7 is an end view of one orientation according to an aspect of the present disclosure whereby the flooring assembly 70 is positioned along support structure 72. FIG. 8 shows a further aspect whereby the floor assembly 70 is deployed to a final deployed state in contact with support structure 72. As shown in FIG. 8, floor segments 10 are now in intimate contact with one another, having been made to removably mate or removably interconnect with one another as adequate tensioning force has been delivered to the tensioning cable 12. FIG. 9 shows a grid-like support structure 90 onto which a floor assembly 92 is being deployed according to aspects of the present disclosure.

FIG. 10 is a flowchart outlining a further aspect of the present disclosure. According to FIG. 10, a method 100 is disclosed comprising 102 positioning a compact floor assembly at a first location; 104 deploying the compact floor assembly to a deployed state, and; 106 actuating a tensioning device to apply tensioning force to a tensioning cable. According to the flowchart presented as FIG. 11, an additional aspect comprises 112 actuating the tensioning device to release tension on the tensioning cable, and 114 retracting the floor assembly from a deployed state to a compacted state.

According to further aspects, the disclosed floor assembly includes a plurality of segments that removably interlock or removably mate together and are reversibly secured together by a tensioning device, such as, for example, a tensioning cable that is in communication with each floor segment. This allows a floor assembly to be compacted for storage (e.g. rolled up, stacked, or otherwise compacted into a desirable orientation) and that is predictably designed to obtain a smaller footprint in the compacted state than known floor assemblies. The floor assembly in the compacted state can more safely and efficiently be delivered to a location for deployment, such as elevated beams or other desired support structure that may be "open" and otherwise be unsafe for workers to traverse.

According to aspects of the present disclosure, once the compacted floor assembly is placed at a deployment location, a single worker can activate the tensioning device that applies a desired tensioning force to the floor segments via the tensioning cable that is in communication with the individual floor segments. It is further contemplated that the process could be entirely automated, and even remotely automated, as a signal can be sent to and received by the actuating device to actuate the tensioning device. In a further aspect, the tensioning device may respond to manual force, whereby a worker operates a manual crank to deliver the required tensioning force. According to a contemplated aspect, a mechanical means such as, for example, an electrical device such as an electric drill may engage to a mechanism such as, for example, a crank configured to engage an actuating device to wind or unwind the cable (for example, about a take-up spindle, etc.) to deliver or release tensioning force to the tensioning cable, as desired. The rigidity or semi-rigidity of the deployed floor assembly is therefore the result of the mating features predictably located on the individual floor segments that are dimensioned to removably mate, or removably interconnect, coupled with the tensioning force delivered to the floor assembly via the tensioning cable. According to aspects, the interlocking or mating features comprise male and female mating features such as, for example, tabs and slots, although any suitable features that predictably assure temporary and removable interlocking are contemplated. For the purposes of this disclosure, the terms "interlock and "mate" are used interchangeably and are equivalent terms.

More than one floor assembly can be deployed across a support structure such as, for example, a beams, or series of spaced beams, etc., to form temporary safe flooring over the support structure. According to a further aspect, the deployed floor assemblies can be secured in a desired position and orientation relative to the support structure by positioning stops integral with, or added to the underside of one or more of the floor segments. A similar predictable positioning of the deployed floor assembly can be achieved, and is therefore contemplated herein, by providing floor segments comprising lateral or otherwise positioned protrusions that are dimensioned to predictably engage a support structure. Such positioning features on one or more of the floor segments contact the beam in a predictable fashion to prevent the deployed floor assembly from moving undesirably relative to the support structure.

When the need for the deployed floor assembly has ceased (e.g. the need to safely support workers on a suspended structure at a specific location is no longer required), according to presently disclosed aspects, the deployed floor assembly can be removed from the support structure and stored more easily and quickly than known temporary flooring systems. According to aspects of the present disclosure, to return the deployed floor assembly to a compacted state, the system is substantially reversed, whereby a release mechanism in communication with an tensioning actuating device is activated to release tension on the tensioning cable. In this way, the deployed floor assembly can be returned to the compacted state (i.e. the compacted floor assembly) for storage or further use elsewhere.

Accordingly, aspects of the present disclosure contemplate an efficient and cost-effective, reusable floor assembly that is in strong contrast to known flooring systems. Unlike known systems where floor segments are either damaged upon removal or designed to be disposable, according to aspects of the present disclosure, the presently disclosed floor systems are designed for reuse, are significantly easier to return to a compacted state, and are also significantly easier to store between uses. As mentioned above, the floor systems according to the present disclosure further take up a significantly smaller footprint in their compacted state.

The floor segments may, according to aspects of the present disclosure, be made from any suitable material that is strong enough to support a desired weight load. Contemplated materials include, without limitation, wood, metal, plastic, composite material, rubber, concrete, cementaceous material, and combinations thereof, etc.

Further, the tensioning cable, according to aspects of the present disclosure, may be made from any suitable material that is strong enough to deliver a desired tension to the floor segments and maintain the desired positioning of the floor segments in an interconnected, or mated state. Contemplated materials include, without limitation, nylon, steel, stainless steel, aluminum or combinations thereof, etc.

Still further, the tensioning device for delivering tension to the tensioning cable, according to aspects of the present disclosure, may be any mechanical device cable of securely engaging an end of the tensioning cable, providing a take-up function (e.g. winding function, etc.), and retaining tension on the tensioning cable for a desired period of time while the floor assembly is in a deployed and tensioned state. Suitable tensioning devices include, without limitation, a ratcheting winch, rank ratchet and clamp, locking crank wheel, cable reel, and combinations thereof. As stated above, the contemplated tensioning devices may be manually actuated, may be automated to be, for example, electrically driven, and may be able to receive a signal sent from a remote or integrated device to actuate and deliver, maintain and release a desired amount of tension relative to the tensioning cable and the floor assembly. A contemplated amount of force provided to the floor assembly and tensioning cable will vary with the demands and design of each particular floor assembly based on a desired use. Contemplated force/tensions range from about 10 to about 100 lbs.

According to present aspects, the floor segments removably or temporarily connect, mate or otherwise engage in a way such that when adequate tensioning force is delivered to the tensioning cable that is in communication with the adjacent floor segments, the tensioning force that is transferred to the floor segments maintains adjacent floor segments, and the floor assembly overall in a semi-rigid or rigid orientation. The features that are integral with the floor segments, and that are contemplated to facilitate the mating of adjacent floor segments can be any reciprocal male/female-type physical structures that insure an intimate "fit" that allows for secure engagement. However, the contemplated mating features must also be mutually and cooperatively dimensioned to easily disengage when the tensioning force diminishes as the actuating device releases tensioning force so that the floor assembly can be returned to a compacted state. While aspects are directed to physical mating features on the floor segments, the present disclosure further contemplates other integral engagement means such as, for example, and without limitation, magnets activated through applying electromagnetic fields that can selectively engage and disengage adjacent floor segments into a deployable and compactable floor assembly, etc.

While aspects of the present disclosure contemplate the tensioning cable engaging the floor segments through and via internal and integral channels in the individual floor segments, other variations (e.g. an exposed channel along an outer surface of the floor segments, or the tensioning cable positioned adjacent to an outer surface of the floor segments) are also contemplated so long as the tensioning cable is able to apply an adequate tensioning force to the floor segments to achieve a rigid or semi-rigid floor assembly capable of supporting a desired weight load.

While illustrative aspects of the disclosure are directed to removable temporary floor assemblies that can be deployed from a compacted state of certain configurations such as, for example and without limitation, a rolled-up, stacked, or expanding accordion configuration, it will be understood that all geometries and configurations of the floor assembly in the compacted state are contemplated. That is, it may be possible to deployed a floor assembly according to the present disclosure, where the compacted state is geometrically complex with the assembly unfolding to a deployed state, such as, for example, deploying irregularly, or in stages to cover a linear or non-linear support structure. The present disclosure therefore contemplates all such variations so long as the floor segments are in communication with a tensioning cable that can transfer tensioning force to the floor segments to achieve a rigid or semi-rigid temporary, and preferably reusable, floor assembly that can revert to a compacted state after its deployment (once the tensioning force is released).

Further, aspects of the present disclosure concern temporary and reusable floor assemblies for any structures including, without limitation, stationary structures, large vehicles, including, without limitation, manned and unmanned vehicles including, without limitation, aircraft, spacecraft, rotorcraft, rockets, satellites, terrestrial vehicles surface and sub-surface waterborne vehicles, and combinations thereof, etc.

When introducing elements of the present disclosure or exemplary aspects or embodiment(s) thereof, the articles "a," "an," "the" and "said" are intended to mean that there are one or more of the elements. The terms "comprising," "including" and "having" are intended to be inclusive and mean that there may be additional elements other than the listed elements. Although this disclosure has been described with respect to specific embodiments, the details of these embodiments are not to be construed as limitations. While the preferred variations and alternatives of the present disclosure have been illustrated and described, it will be appreciated that various changes and substitutions can be made therein without departing from the spirit and scope of the disclosure.

What is claimed is:

1. A method for installing a removable floor assembly comprising the steps of:

positioning a floor assembly in a compacted state at a first location, said floor assembly comprising:

a plurality of individual floor segments, said floor segments positioned substantially adjacent to one another, with said individual floor segments each comprising a reinforcement, said reinforcement dimensioned to engage with a recess in an adjacent floor segment, said recess dimensioned to accommodate the reinforcement, and said reinforcement dimensioned to removably interconnect individual floor segments with one another;

a tensioning cable in communication with the floor segments; and a tensioning device in communication with the tensioning cable;

deploying the compacted floor assembly from the compacted state at the first location to a deployed state onto a structural support; and actuating the tensioning device to apply a tensioning force to the tensioning cable.

2. The method of claim 1, wherein the floor segments are dimensioned to temporarily mate.

3. The method of claim 1, wherein the compacted state comprises rolled floor segments, folded floor segments or combinations thereof.

4. The method of claim 1, wherein the floor segments comprise integral channels to receive the tensioning cable.

5. The method of claim 1, wherein at least a portion of the tensioning force is transferred from the tensioning cable to the floor segments.

6. The method of claim 1, wherein the tensioning device applies a tensioning force to the tensioning cable, said tensioning force ranging from about 10 to about 100 lbs.

7. The method of claim 1, wherein the tensioning cable is made from a material selected from the group comprising nylon, steel, stainless steel, aluminum, or combinations thereof.

8. The method of claim 1 further comprising the steps of:

actuating the tensioning device to release tension on the tensioning cable; and retracting the floor assembly from the deployed state to the compacted state.

9. A removable floor assembly comprising:

a plurality of substantially adjacent individual floor segments, said individual floor segments each comprising a reinforcement, said reinforcement dimensioned to engage with a recess in an adjacent floor segment, said recess dimensioned to accommodate the reinforcement, and said reinforcement dimensioned to removably interconnect individual floor segments with one another;

a tensioning cable in communication with the floor segments; and a tensioning device in communication with the tensioning cable.

10. The assembly of claim 9, further comprising a release mechanism in communication with the tensioning device.

11. The assembly of claim 9, wherein the floor segments are dimensioned to temporarily mate.

12. The assembly of claim 9, wherein the tensioning device is configured to apply a tensioning force to the tensioning cable, said tensioning force ranging from about 10 to about 100 lbs.

13. The assembly of claim 9, wherein the tensioning cable is made from a material comprising nylon, steel, stainless steel, aluminum, or combinations thereof.

14. The assembly of claim 9, wherein the floor assembly is configured to deploy from a compacted state to a deployed state.

* * * * *